US009934743B2

(12) United States Patent
Yamamoto

(10) Patent No.: US 9,934,743 B2
(45) Date of Patent: Apr. 3, 2018

(54) DRIVE DEVICE, DRIVE METHOD, DISPLAY DEVICE AND DISPLAY METHOD

(71) Applicant: Sharp Kabushiki Kaisha, Osaka (JP)

(72) Inventor: Keiichi Yamamoto, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 201 days.

(21) Appl. No.: 14/782,244

(22) PCT Filed: Feb. 20, 2014

(86) PCT No.: PCT/JP2014/053999
§ 371 (c)(1),
(2) Date: Oct. 2, 2015

(87) PCT Pub. No.: WO2014/162791
PCT Pub. Date: Oct. 9, 2014

(65) Prior Publication Data

US 2016/0027394 A1 Jan. 28, 2016

(30) Foreign Application Priority Data

Apr. 3, 2013 (JP) ..... 2013-078044

(51) Int. Cl.
*G09G 3/36* (2006.01)

(52) U.S. Cl.
CPC ..... *G09G 3/3659* (2013.01); *G09G 3/3648* (2013.01); *G09G 3/3655* (2013.01); *G09G 3/3677* (2013.01); *G09G 3/3688* (2013.01); *G09G 2310/061* (2013.01); *G09G 2330/027* (2013.01)

(58) Field of Classification Search
None
See application file for complete search history.

(56) References Cited

U.S. PATENT DOCUMENTS

| | | | |
|---|---|---|---|
| 2009/0027322 | A1 | 1/2009 | Hosotani |
| 2011/0175883 | A1 | 7/2011 | Toyotaka et al. |
| 2012/0127152 | A1 | 5/2012 | Masui |

FOREIGN PATENT DOCUMENTS

| | | | |
|---|---|---|---|
| JP | 2011-170327 | A | 9/2011 |
| JP | 2012-113088 | A | 6/2012 |
| JP | 2012-133182 | A | 7/2012 |
| WO | 2007/099673 | A1 | 9/2007 |

*Primary Examiner* — Gustavo Polo
(74) *Attorney, Agent, or Firm* — Chen Yoshimura LLP

(57) ABSTRACT

A display drive circuit (drive device) has a signal line drive circuit that, before the display panel is turned OFF, writes prescribed data signals to a respective plurality of pixels via a plurality of source signal lines, such that the potential of the drain electrodes of the respective pixels becomes equal to the potential of the opposite electrode after the display panel is turned OFF.

7 Claims, 8 Drawing Sheets

DRIVE DEVICE, DRIVE METHOD, DISPLAY DEVICE AND DISPLAY METHOD

TECHNICAL FIELD

The present invention relates to a drive device, drive method, display device, and display method.

This application claims the benefit of Japanese Patent Application 2013-078044, filed in Japan on Apr. 3, 2013, which is hereby incorporated in its entirety.

BACKGROUND ART

The following problems below may be exhibited by liquid crystal display devices (liquid crystal displays) using TFTs (thin film transistors) with excellent OFF characteristics, such as TFTs having oxide semiconductors, in a drive device. Such TFTs have favorable OFF characteristics and low leakage current when OFF. Thus, charge may remain in the pixels even after the power is turned OFF, which may result in a long period of DC potential (direct current potential) being applied to the liquid crystal. In other words, if charge remains between pixel electrodes when the power is OFF, the charge will be held for a long period of time, which could result in screen burn-in, liquid crystal degradation, or the like.

Patent Document 1 discloses a technique for obviating the continuous application of voltage on liquid crystal when the power of the liquid crystal display is OFF. In the liquid crystal display described in Patent Document 1, before the power is stopped, a fixed potential is written to the capacitive elements of all of the pixels, and an initialization image is displayed with almost zero difference in potential between the electrodes of the capacitive elements. After the difference in potential between the electrodes of the capacitive elements is approximately zero, the power supply is stopped. In other words, an OFF sequence is performed when turning OFF the power whereby a fixed potential is written such that liquid crystal application voltage becomes 0V, and, after this fixed potential is written, the power is turned OFF.

RELATED ART DOCUMENT

Patent Document

Patent Document 1: Japanese Patent Application Laid-Open Publication No. 2011-170327

SUMMARY OF THE INVENTION

Problems to be Solved by the Invention

The following are examples of the writing of the fixed potential to the capacitive elements and the turning OFF of the power in the OFF sequence described in Patent Document 1. First, fixed potentials are written to the capacitive elements of the respective pixels such that an ON voltage is applied to the gate lines to sequentially turn ON the respective TFTs and such that source voltage=COM voltage, for example. In this example, COM voltage is the voltage of the opposite electrode that is opposite to the respective pixels, and is also called the "common electrode voltage" or "opposite electrode voltage." Next, the power is turned OFF by setting the power-supply voltage to ground potential.

When the power-supply voltage is turned OFF, the potential of the gate lines ultimately returns to GND (i.e., ground potential). When the gate lines return to GND, the potential of the capacitive elements of the respective pixels changes due to Cgd lead-in. Namely, the 0V applied to the liquid crystal immediately before power OFF changes to a voltage that is not 0V after power OFF. Therefore, a voltage, while small, is still applied to the liquid crystal after power OFF. Cgd is the coupling capacitance between the gate and drain of the TFT. In other words, in the liquid crystal display described in Patent Document 1, voltage is not being applied to the liquid crystal at the point where the fixed potential has been written to all of the pixels. When the power is turned OFF thereafter, however, the drain voltage fluctuates due to fluctuation of the gate voltage, which ultimately leaves a difference in potential between the drain electrode and the opposite electrode.

One aspect of the present invention was made in view of the above-mentioned situation and aims at providing a drive device, drive method, display device, and display method capable of reducing the difference in potential that results during power OFF between the drain electrodes of the respective pixels and the opposite electrode.

Means for Solving the Problems

As a first configuration to solve the above-mentioned problems, one aspect of the present invention is a drive device for driving a display panel equipped with pixels each having a transistor including a drain electrode, a source electrode, and a gate electrode, gate signal lines connected to gate electrodes of the respective transistors, and source signal lines connected to source electrodes of the respective transistors, the drive device including: a scan line drive circuit that sequentially selects the gate signal lines for scanning; a signal line drive circuit that writes data signals to the respective plurality of pixels connected to each of the gate signal lines that has been selected; and an opposite electrode voltage generation circuit that generates a potential for an opposite electrode that is opposite to the respective pixels, wherein, when the drive device enters a turn OFF sequence for turning OFF the display panel, the signal line drive circuit writes prescribed data signals to the respective pixels via the source signal lines before turning OFF the display panel such that, after the display panel is turned OFF, a potential of the drain electrodes of the respective pixels becomes equal to the potential of the opposite electrode.

As a second configuration to solve the above-mentioned problems, another aspect of the present invention is the drive device, further including: a timing controller that outputs image signals indicating gradation values of the respective pixels to the signal line drive circuit and a control signal for indicating an output timing of the image signals, wherein, when the drive device enters the turn OFF sequence for turning OFF the display panel, the timing controller outputs a prescribed image signal indicating gradation values such that, after the display panel is turned OFF, the potential of the drain electrodes of the respective pixels becomes equal to the potential of the opposite electrode, and wherein the prescribed data signals written by the signal line drive circuit are generated by the signal line drive circuit in accordance with the image signals received from the timing controller.

As a third configuration to solve the above-mentioned problems, another aspect of the present invention is the drive device, further including: a timing controller that outputs a power OFF control signal for instructing a power OFF operation to the signal line drive circuit when the drive device enters the turn OFF sequence for turning OFF the display panel, wherein the signal line drive circuit, in response to the power OFF control signal from the timing controller, writes the prescribed data signals to the respective pixels via the source signal lines before turning OFF the display panel such that, after the display panel is turned OFF, the potential of the drain electrodes of the respective pixels becomes equal to the potential of the opposite electrode.

As a fourth configuration to solve the above-mentioned problems, another aspect of the present invention is the drive device, wherein the prescribed data signals are signals applied to the source electrodes by the signal line drive circuit, the prescribed data signals having a liquid crystal application voltage of VS=VGH*Cgd/(Clc+Ccs+Cgd), where VS is the liquid crystal application voltage, VGH is gate-ON voltage, Cgd is coupling capacitance between gate-drain, Clc is liquid crystal capacitance, and Ccs is auxiliary capacitance.

As a fifth configuration to solve the above-mentioned problems, another aspect of the present invention is the drive device, wherein the signal line drive circuit, when writing the prescribed data signals to the respective pixels, collectively selects a prescribed plurality of the gate signal lines.

As a sixth configuration to solve the above-mentioned problems, another aspect of the present invention is a display device, including: a display panel equipped with pixels each having a transistor including a drain electrode, a source electrode, and a gate electrode, gate signal lines connected to gate electrodes of the respective transistors, and source signal lines connected to source electrodes of the respective transistors; and a drive device equipped with: a scan line drive circuit that sequentially selects the gate signal lines for scanning; a signal line drive circuit that writes data signals to the respective plurality of pixels connected to each of the gate signal lines that has been selected; and an opposite electrode voltage generation circuit that generates a potential of an opposite electrode that is opposite to the respective pixels, wherein, when the drive device enters a turn OFF sequence for turning OFF the display panel, the signal line drive circuit writes prescribed data signals to the respective pixels via the source signal lines before turning OFF the display panel such that, after the display panel is turned OFF, a potential of the drain electrodes of the respective pixels becomes equal to the potential of the opposite electrode.

As a seventh configuration to solve the above-mentioned problems, another aspect of the present invention is a drive method for driving a display panel equipped with pixels each having a transistor including a drain electrode, a source electrode, and a gate electrode, gate signal lines connected to gate electrodes of the respective transistors, and source signal lines connected to source electrodes of the respective transistors, the drive method including: using a scan line drive circuit that sequentially selects the gate signal lines for scanning, a signal line drive circuit that writes data signals to the respective plurality of pixels connected to each of the gate signal lines that has been selected, and an opposite electrode voltage generation circuit that generates a potential of an opposite electrode that is opposite to the respective pixels; receiving, by the signal line drive circuit, a power OFF control signal for instructing a power OFF operation; and writing, by the signal line drive circuit in response to the power OFF control signal, prescribed data signals to the respective pixels via the source signal lines before turning OFF the display panel such that, after the display panel is turned OFF, a potential of the drain electrodes of the respective pixels becomes equal to the potential of the opposite electrode.

As a first an eighth configuration to solve the above-mentioned problems, another aspect of the present invention is a display method, including: using a display panel equipped with pixels each having a transistor including a drain electrode, a source electrode, and a gate electrode, gate signal lines connected to gate electrodes of the respective transistors, and source signal lines connected to source electrodes of the respective transistors, a scan line drive circuit that sequentially selects the gate signal lines for scanning, a signal line drive circuit that writes data signals to the respective plurality of pixels connected to each of the gate signal lines that has been selected, and an opposite electrode voltage generation circuit that generates a potential of an opposite electrode that is opposite to the respective pixels; and writing, by the signal line drive circuit, prescribed data signals to the respective pixels via the source signal lines before turning OFF the display panel such that, after the display panel is turned OFF, a potential of the drain electrodes of the respective pixels becomes equal to the potential of the opposite electrode.

Effects of the Invention

According to one aspect of the present invention, before the display panel is turned OFF, a signal line drive circuit respectively writes prescribed data signals to a plurality of pixels via a plurality of source signal lines such that, after the display panel is turned OFF, the potential of the drain electrodes of the respective pixels becomes equal to the potential of the opposite electrode.

In this example, the prescribed data signals take into consideration the difference in potential that ultimately remains between the drain electrodes and the opposite electrode caused by fluctuations in the drain voltage due to fluctuations in the gate voltage when the power is turned OFF. Accordingly, it is possible to reduce the difference in potential that results during power OFF between the drain electrodes of the respective pixels and the opposite electrode.

DETAILED DESCRIPTION OF EMBODIMENTS

Embodiment 1

Embodiment 1 of the present invention will be explained below with reference to the drawings.

(Configuration of Display Device)

Figure 1:
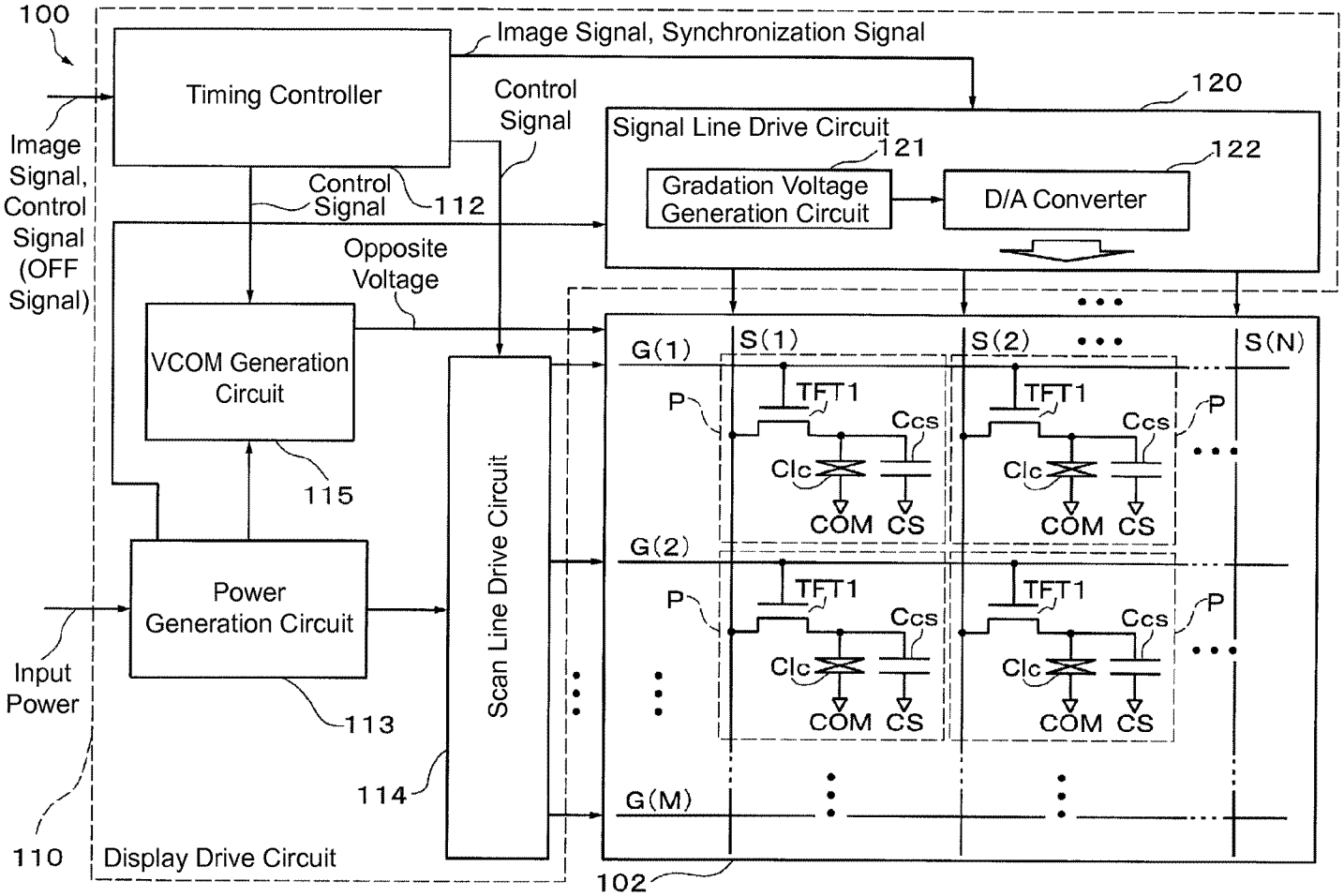
FIG. 1 is a block view of a configuration of primary components of a display device according to Embodiment 1 of the present invention.

First, a configuration example of a display device 100 of Embodiment 1 will be described with reference to FIG. 1. FIG. 1 is a block view of a configuration of primary components of a display device according to Embodiment 1 of the present invention. This display device 100 can be used for displaying various types of images in an electronic book terminal, smartphone, mobile phone, PDA (portable information terminal), laptop computer, portable gaming system, car navigation system, and the like, for example.

As shown in FIG. 1, the display device 100 includes a display panel 102 and a display drive circuit 110 (drive device).

(Display Panel)

The display panel 102 displays images that are based on image signals input to the display device 100.

This display panel 102 is a so-called active-matrix liquid crystal display panel. The display panel 102 includes a plurality of pixels P, a plurality of gate signal lines G (M amount of gate signal lines G(1) to G(M)), and a plurality of source signal lines S (N amount of gate signal lines S(1) to S(N)).

The plurality of pixels P are arrayed in a lattice pattern. This makes the plurality of pixels P form a plurality of pixel rows and a plurality of pixel columns (N pixel columns×M pixel rows). In the present embodiment, each of the pixels P is a TFT liquid crystal pixel. One of the gate signal lines G is provided for each pixel row. The respective gate signal lines G are provided as signal paths for supplying gate signals (scan signals) to the respective pixels P in the corresponding pixel rows. One of the source signal lines S is provided for each pixel column. The respective source signal lines S are provided as signal paths for supplying source signals (image data signals) to the respective pixels P in the corresponding pixel columns.

Each of the pixels P has an n-channel transistor TFT 1, which is a thin film transistor.

Each of the TFTs 1 has a source electrode connected to one of the source signal lines S. Each of the TFTs 1 also has a gate electrode connected to one of the gate signal lines G. The drain of the TFT 1 is connected to one end of a liquid crystal capacitance Clc and to one end of an auxiliary capacitance Ccs via the pixel electrode. The other end of the liquid crystal capacitance Clc is connected to an opposite electrode COM. The other end of the auxiliary capacitance Ccs is connected to an auxiliary electrode CS. This auxiliary capacitance Ccs is also referred to as a "storage capacitor," or the like. In the present embodiment, the opposite electrode COM and the auxiliary electrode CS are connected so as to have an equal potential. The TFT 1 turns ON when a prescribed ON voltage is applied to the gate signal line G connected to the gate electrode. The TFT 1, when turned ON, has a voltage being applied to the source signal line S connected to the source electrode written to the liquid crystal capacitance Clc and the auxiliary capacitance Ccs.

(Display Drive Circuit)

The display drive circuit 110 drives the display panel 102 in accordance with input image signals in order to cause images based on these image signals to be displayed on the display panel 102. As shown in FIG. 1, the display drive circuit 110 includes a timing controller 112, power generation circuit 113, scan line drive circuit 114, VCOM generation circuit (opposite electrode voltage generation circuit) 115, and a signal line drive circuit 120.

(Timing Controller)

The timing controller 112 receives control signals such as image signals and OFF signals from outside (from a system-side controller unit, for example). The term "image signals" includes clock signals, synchronization signals, image data signals, and the like. Furthermore, the OFF signal is a control signal that instructs the display device 100 to turn OFF (stop). The timing controller 112, in accordance with these image signals, control signals, and the like, controls operation and operation timing of the respective drive circuits (scan line drive circuit 114, VCOM generation circuit 115, and signal line drive circuit 120). The timing controller 112 outputs, to the scan line drive circuit 114, a control signal including a clock signal or the like as a scan control signal, for example. The timing controller 112 supplies, to the signal line drive circuit 120, an image signal (image data signal) and a synchronization signal (a control signal indicating output timing). The control of the timing controller 112 causes the respective drive circuits to operate in synchronization with one another and causes an image that is based on the image signal to be displayed on the display panel 102.

(Power Generation Circuit)

The power generation circuit 113 generates the respective potentials required by the scan line drive circuit 114, VCOM generation circuit 115, and signal line drive circuit 120 from an input power supply received from outside (a system-side controller unit, for example). The power generation circuit 113 respectively supplies the generated voltages to the scan line drive circuit 114, VCOM generation circuit 115, and signal line drive circuit 120.

(Scan Line Drive Circuit)

The scan line drive circuit 114 drives the respective gate signal lines G in accordance with the scan control signals supplied from the timing controller 112. Specifically, the scan line drive circuit 114, in accordance with the scan control signals, sequentially selects a plurality of the gate signal lines G one-at-a-time and applies an ON voltage (i.e., supplies a gate signal) to the selected gate signal lines G. The scan line drive circuit also applies an OFF voltage to the non-selected gate signal lines G. This switches the TFT 1, which is a switching device, to either ON or OFF in the respective pixels P on the gate signal lines G. In the present embodiment, the switching device of the respective pixels is an n-channel TFT, but other switching devices may be used instead. Furthermore, the scan line drive circuit 114 can make it so all or part of the plurality of gate signal lines G are collectively selected before power OFF, for example.

(Signal Line Drive Circuit)

The signal line drive circuit 120 has a gradation voltage generation circuit 121 and a D/A converter 122. The gradation voltage generation circuit 121 generates, with prescribed voltages supplied from the power generation circuit 113 as input, analog voltages that are based on a plurality of gradation values in accordance with the characteristics of the liquid crystal. The D/A converter 122 generates and outputs, in accordance with the digital image signals, an analog signal of a voltage value that is based on the gradation values of the respective pixels for each pixel P. In this example, the analog signal output from the D/A converter 122 and applied (i.e., written) to the respective pixels P via the source signal lines S is referred to as an "image data signal." The signal line drive circuit 120 writes the image data signals via the plurality of source signal lines S to the respective pixels P connected to the selected gate signal line G. At such time, the signal line drive circuit 120, in accordance with the synchronization signal supplied from the timing controller 112, writes an image data signal that is based on the image signal supplied from the timing controller 112. The signal line drive circuit writes this image data signal to the respective pixels P on the gate signal line G driven by the scan line drive circuit 114. Specifically, the signal line drive circuit 120 applies a voltage that is based on the image data signal to be written to the relevant pixel P for the respective pixels P on the driven gate signal line G via the corresponding source signal line S.

This writes the image data signal to the respective pixels P.

The respective pixels P then receive the image data signal on the pixel electrode of the liquid crystal capacitance Clc. Due to this, in the respective pixels P, the array direction of the liquid crystal sealed between the pixel electrode of the liquid capacitance and the opposite electrode COM changes in accordance with the differential between the voltage level of the supplied image data signal and the voltage level of the opposite voltage supplied to the opposite electrode COM. This displays an image with a gradation that is based on this differential.

It should be noted that Embodiment 1 has a function whereby, before the display panel 102 is turned OFF, the signal line drive circuit 120 respectively writes prescribed image data signals to the plurality of pixels P via the plurality of source signal lines S such that, after the display panel 102 is turned OFF, the potential of the drain electrodes of the respective pixels P becomes equal to the potential of the opposite electrode COM. In such a case, the data representing the prescribed image data signals can be made to be stored in advance in a prescribed storage unit in the timing controller 112.

(Opposite Electrode Voltage Generation Unit)

The VCOM generation circuit (opposite electrode voltage generation circuit) 115 receives a prescribed voltage from the power generation circuit 113 and supplies an opposite voltage VCOM for driving the opposite electrode COM to the opposite electrode COM, which is common to the plurality of pixels P. The VCOM generation circuit 115 outputs an opposite voltage differing from GND (ground potential) in a normal scan period and outputs an opposite voltage that is the same as GND (ground potential) during an erasure scan period, a power OFF period, or the like, for example. In this example, the normal scan period means a period of operation in a state (normal display state) in which the display panel 102 is displaying a prescribed image, i.e., a moving image or a still-image, in accordance with an image signal. The erasure scan period means, in preparation for power OFF, a period of writing prescribed image data signals to respective pixels P before the power OFF period in order to return the display panel 102 to an initial state during the power OFF period.

The power OFF period means a period in which the power generation circuit 113 stops output and the respective output signals or output voltages of the VCOM generation circuit 115, scan line drive circuit 114, and signal line drive circuit 120 become GND (ground potential).

(Example of Controlling Liquid Crystal Application Voltage)

Figure 2:
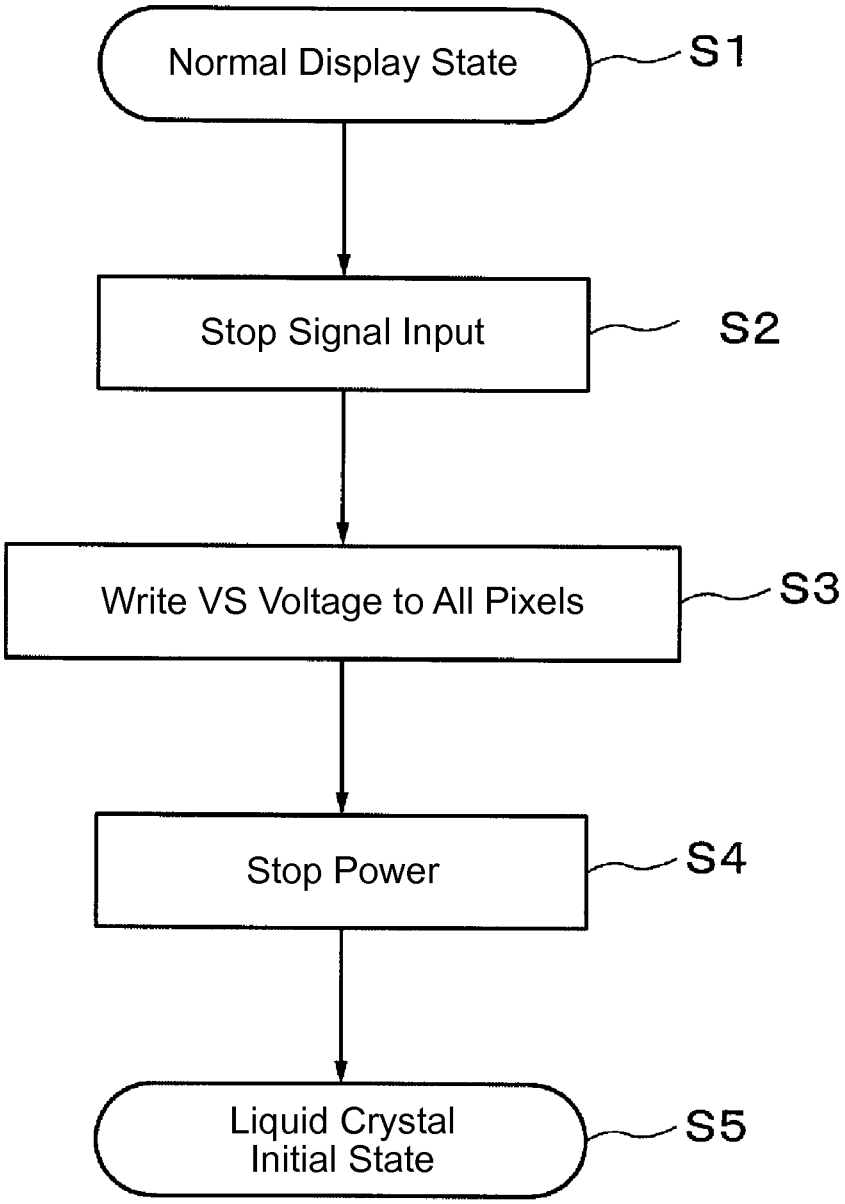
FIG. 2 is a flow chart showing a flow of a power OFF sequence of the display device 100 shown in FIG. 1.

An example of controlling the liquid crystal application voltage VS in the display device 100 according to Embodiment 1 will be described below with reference to FIGS. 2, 3, and 4. In this example, the liquid crystal application voltage VS represents a voltage of an image data signal written, before the display panel 102 is turned OFF, to the plurality of pixels P via the plurality of source signal lines S such that, after the display panel 102 is turned OFF, the potential of the drain electrodes of the respective pixels P becomes equal to the potential of the opposite electrode voltage VCOM. FIG. 2 is a flow chart showing a flow of a power OFF sequence of the display device 100 shown in FIG. 1. First, the basic flow of the power OFF sequence process of the display device 100 according to Embodiment 1 will be explained with reference to the flow chart shown in FIG. 2.

In the normal display state (i.e., normal scan period) (S1), if the timing controller 112 receives an OFF signal (stop signal) from outside (S2), the operation state enters the erasure scan period.

In the erasure scan period, the respective units operate as follows (S3). First, the timing controller 112 transmits an image signal (gradation value) corresponding to the liquid crystal application voltage (VS voltage) during the erasure scan period to the scan line drive circuit 114. The timing controller 112 then controls so as to become GND output with respect to the VCOM generation circuit 115 (power OFF, GND voltage output, or the like). Next, the signal line drive circuit 120 receives image signals from the timing controller 112 as usual, and in accordance with these image signals writes the VS voltage to the respective pixels P from all lines S(1) to S(N). The scan line drive circuit 114 scans the gate signal lines G as usual. The driving of the gate signal lines G by the scan line drive circuit 114, however, is not limited to sequential scans, and may be collective simultaneous writing or the like.

Next, the power generation circuit 113 stops the output of the respective voltages (S4). In other words, the power generation circuit 113 turns OFF the respective power-supply outputs, outputs a ground potential. The timing at which the outputs are turned OFF is received by the timing controller 112, for example. After the writing of the liquid crystal application voltage (VS voltage) in the erasure scan period is completed for all pixels P, for example, the timing controller 112 outputs a signal indicating to turn the outputs OFF to the power generation circuit 113.

In the power supply OFF period, the display state of the display panel 102 is initialized as follows (S5). First, the timing controller 112 stops operation via power OFF. Then, the signal line drive circuit 120 causes output voltage to change from VS to GND via power OFF. Next, the scan line drive circuit 114 causes output to change the level of the gate signal line G from VGL to GND via power OFF. In this example, VGL is a signal for when the gate is caused to turn OFF. As a result of the operations described above, the ultimate application voltage to the liquid crystal pixels P can be made 0V.

Next, an example of controlling the liquid crystal application voltage VS of the display device 100 according to Embodiment 1 will be explained in detail with reference to FIG. 3 and FIG. 4. FIG. 3 is a circuit diagram showing an equivalent circuit including a coupling capacitance of the pixel P shown in FIG. 1. FIG. 4 is a timing chart that shows operation waveforms of the respective units of the display device 100 in FIG. 1.

Figure 3:
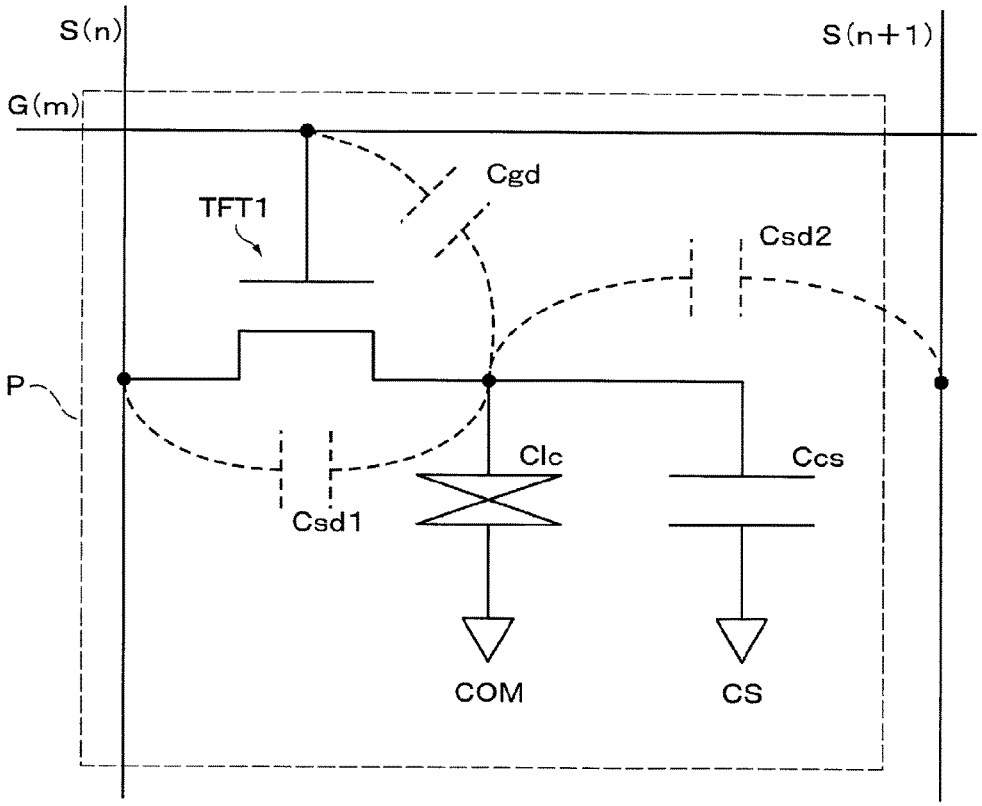
FIG. 3 is a circuit diagram showing an equivalent circuit including a coupling capacitance of a pixel P shown in FIG. 1.

FIG. 3 shows a configuration of one of the pixels P among the plurality of pixels of the display panel 102. It should be noted that other pixels P included in the display panel 102 have a configuration similar to the above-mentioned pixel P. Furthermore, configurations that are the same as that shown in FIG. 1 are given the same reference characters. In addition, the gate signal lines G (m) represent $m^{th}$ gate signal lines (where m is any number from 1 to M). The source signal lines S (n) and S (n+1) represent $n^{th}$ and $n+1^{th}$ source signal lines (where n is any number from N to 1). In other words, the source signal lines S (n) and S (n+1) are adjacent to one another.

In FIG. 3, Cgd is the coupling capacitance (i.e., parasitic capacitance) between gate and drain.

Csd1 is the coupling capacitance between source signal line S(n) and drain. Csd2 is the coupling capacitance between source signal lines S (n+1) and drain. In FIG. 3, Clc is the liquid crystal capacitance, and Ccs is the auxiliary capacitance. COM is the opposite electrode, and CS is the auxiliary electrode.

Figure 4:
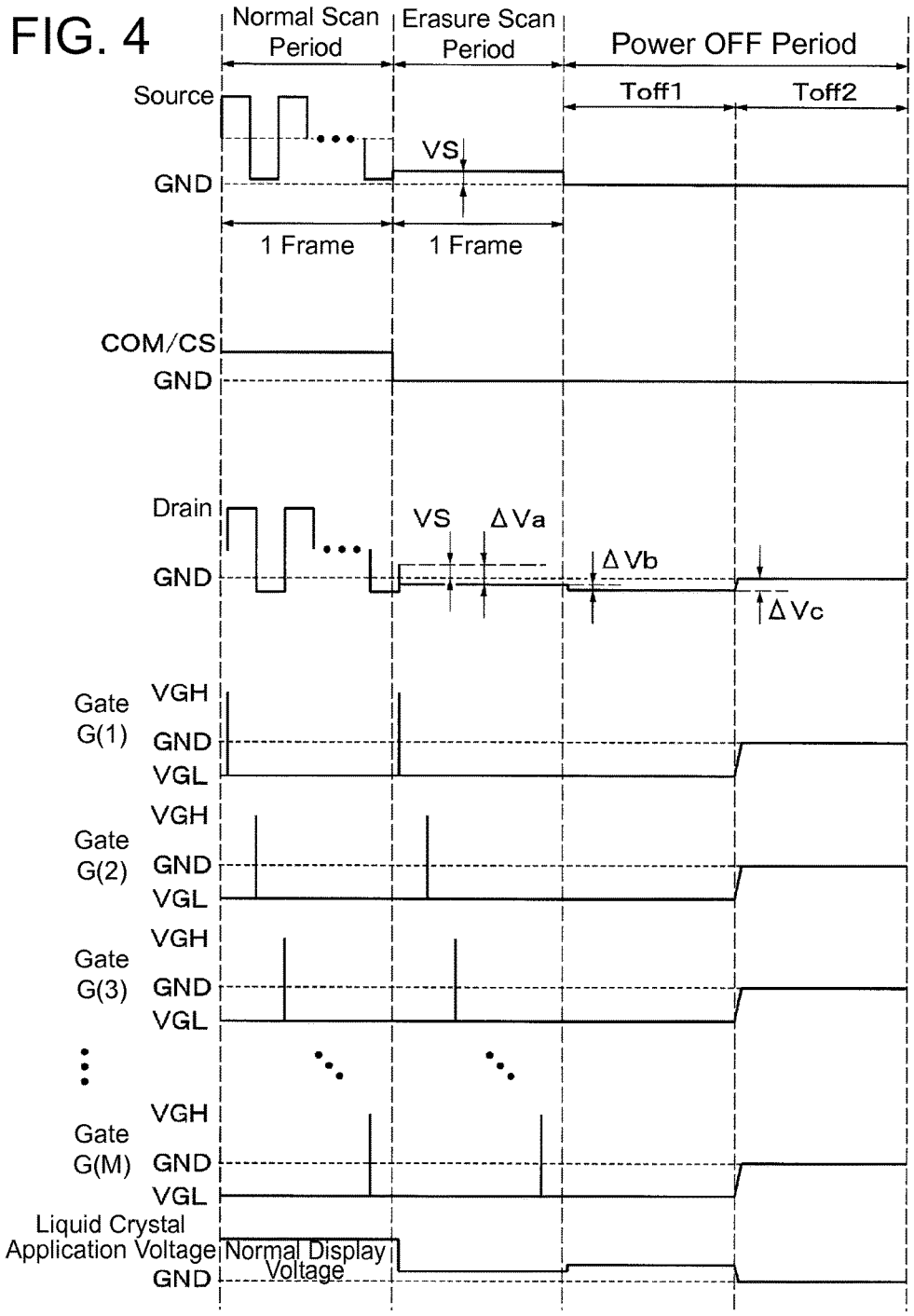
FIG. 4 is a timing chart showing operation timing of respective units of the display device 100 shown in FIG. 1.

In FIG. 4, the topmost waveform shows the potential of the source electrode of the plurality of TFTs 1 connected to any one of the source signal lines S. The second waveform shows the potential of the opposite electrode COM and the auxiliary electrode CS. The third waveform shows the potential of the drain electrode of the plurality of TFTs 1, which have been written with the topmost source voltage. The fourth waveform onwards represents the potential of the plurality of gate signal lines G, and the absolute value of the voltage between the drain electrode and opposite electrode COM, i.e., the liquid crystal application voltage (bottom-most waveform).

As shown in FIG. 4, in the display device 100, there is a normal scan period, erasure scan period, and power OFF period. As described above, the "normal scan period" is a period in which the display panel 102 is driven in accordance with a received image signal and the display panel 102 is caused to display an image that is based on the image signal. The "erasure scan period" is a period in which, before the display device 100 is turned OFF, the liquid crystal application voltage VS is written to the respective plurality of pixels P. The "power OFF period" is a period in which the power of the display device 100 is switched to OFF. It should be noted that, in FIG. 4, the "power OFF period" is divided into two at the timing when the gate voltage switches from the OFF voltage VGL to GND, and is shown as time Toff1 and time Toff2. In FIG. 4, the respective sections of the normal scan period and erasure scan period that are demarcated by the dotted line correspond to one frame. The power OFF period or time Toff1 and time Toff2 may correspond to one frame, but need not necessarily correspond to one frame.

The operations of the display device 100 during the respective normal scan period, erasure scan period, and power OFF period will be specifically explained below.

(1) Normal Scan Period

In the normal scan period, first, corresponding image data is supplied from the signal line drive circuit 120 to the source electrodes of the respective pixels P via the corresponding source signal lines S.

Then, when an ON voltage is applied to the gate electrodes of the pixels P via the corresponding gate signal lines G, the TFTs 1 of the pixels P turn ON. This supplies the image data received by the source electrodes to the drain electrodes via the TFTs 1 in the pixels P. In other words, the image data is written to the respective pixels P. Then, in the pixels P, the amount of light transmitted by the liquid crystal is adjusted in accordance with the difference in potential between the drain electrode and the opposite electrode COM, and an image that is based on the image data is displayed. The image data written to the pixels P is held in the pixels P until the frame ends. If there is a pause period after the frame, however, the above-mentioned image data may be held in the pixels P during this pause period.

The display device 100 repeats the above-mentioned operations during the normal scan period. This writes image data to the pixels P for each frame and displays an image that is based on this image data. It should be noted that, in the example shown in FIG. 4, the display device 100 adopts a driving scheme that inverts the polarity of the image data each frame. Furthermore, a column-inversion driving scheme is used whereby the polarity of the image data in adjacent columns is inverted. In addition to this, however, it is possible for the display device 100 to use a line-inversion driving scheme whereby the polarity differs for each line, a driving scheme that inverts polarity every two or more frames, a driving scheme whereby a pause period (pause frame) in which the image data is written is not provided, and the like.

In this example, as shown in FIG. 4, the potential of the drain electrode is shifted more towards the negative pole than the potential of the source electrode. This type of shift occurs because of the resistance of the TFTs 1 and the wiring lines, the effects of coupling, and the like. Due to this, the reference potential of the source electrode is GND, whereas the reference potential of the drain electrode is shifted downwards (to the negative pole).

Furthermore, the potential of the opposite electrode COM is controlled so as to be a potential that is shifted more towards the positive pole than GND. A gate ON voltage VGH that turns ON the TFT 1 and a gate OFF voltage VGL is applied to the gate electrode. The liquid crystal application voltage (shown as an absolute value) is the normal display voltage.

(2) Erasure Scan Period

When the power of the display device 100 is turned OFF, first, a control signal to turn OFF the power supply of the display device 100 is supplied from outside (from a system-side controller, for example) to the timing controller 112. When this control signal is received by the timing controller 112, the display device 100 enters the erasure scan period.

In the erasure scan period, a prescribed liquid crystal application voltage VS is applied to the source electrode. The value of this liquid crystal application voltage VS is set by the gradation value of the image signal output from the timing controller 112. The timing controller 112 outputs an image signal as the liquid crystal application voltage VS to all of the pixels P. Calculation examples of specific values are described later. The opposite electrode COM becomes GND. In the erasure scan period, the movement of the liquid crystal application voltage (i.e., the voltage between the drain electrode and opposite electrode COM) is as follows. First, when the gate electrode is gate ON voltage VGH, the drain potential is VS. In this example, the liquid crystal application voltage=VS, but when the gate turns OFF thereafter (i.e., when the gate electrode is OFF voltage VGL), the liquid crystal application voltage changes by ΔVa. It should be noted that, in such a case, VGH is a positive potential with GND as a reference, and VGL is a negative potential with GND as a reference. When the voltage of the gate electrode is VGL, the drain electrode fluctuates by $\Delta Va=(VGH-VGL)*Cgd/Cpix$ due to the drain electrode being affected by the potential fluctuation VGH−VGL. In this example, the potential or rather the liquid crystal application voltage of the drain electrode fluctuates by ΔVa, and becomes VS−ΔVa. It should be noted that Cpix=Clc+Ccs+Cgd+Csd (see FIG. 3). Furthermore, Csd=Csd1+Csd2. Hereinafter, in the present embodiment, "*" represents the character used for multiplication; thus, the multiplication of a by b would be represented by a*b, for example.

(3) Power OFF Period

In the subsequent power OFF period, first, the source voltage changes from VS to GND in time Toff1, and then the gate voltage changes from VGL to GND in time Toff2. In time Toff1, first, the source potential changes from VS to GND, which causes the potential of the drain electrode to fluctuate by AVb=VS*Csd/Cpix and become VS−ΔVa−Vb from VS−ΔVa as previously.

In addition, in time Toff2, the gate potential changes from VGL to GND, which causes the potential of the drain electrode to fluctuate by ΔVc=VGL*Cgd/Cpix, thereby ultimately becoming VS−ΔVa−ΔVb−ΔVc.

VS, which is the final potential VS−ΔVa−ΔVb−ΔVc=0, is found, and then written from the source signal lines S to the respective pixels P in the erasure scan period to cause the final potential to be 0V (GND).

Accordingly, as shown by the bottommost waveform in FIG. 4, when the power is completely OFF, the liquid crystal application voltage becomes 0V (GND) in Toff2 of the power OFF period and does not generate unnecessary residual charge.

"VS−ΔVa−ΔVb−ΔVc=0" is a linear equation, and thus:

$$VS(1-Csd/Cpix)=(VGH-VGL)*Cgd/Cpix+VGL*Cgd/Cpix.$$

Solving this results in:

$$VS=VGH*Cgd/(Cpix-Csd)=VGH*Cgd/(Clc+Ccs+Cgd).$$

It should be noted that, in the example shown in FIG. 4, time Toff1 in which the voltage of the source signal line S of the power OFF period changes from VS to GND is shown having a different timing from that of time Toff2 in which the gate voltage changes from VGL to GND, but in practice may be simultaneous or in the opposite order.

As described above, in Embodiment 1, in the erasure scan period, the voltage of the source signal line S is configured so as to become VS=VGH*Cgd/(Clc+Ccs+Cgd), thereby allowing the ultimate voltage applied to the liquid crystal pixels P to be 0V. In other words, Embodiment 1 makes it possible to prevent unnecessary residual charge by setting the liquid crystal application voltage (the voltage between the opposite electrode and the pixel (drain) electrodes) of the respective pixels P to 0V when the power OFF period has finished.

It should be noted that the display device 100 may have the erasure scan period in one frame or multiple frames.

Figure 7:
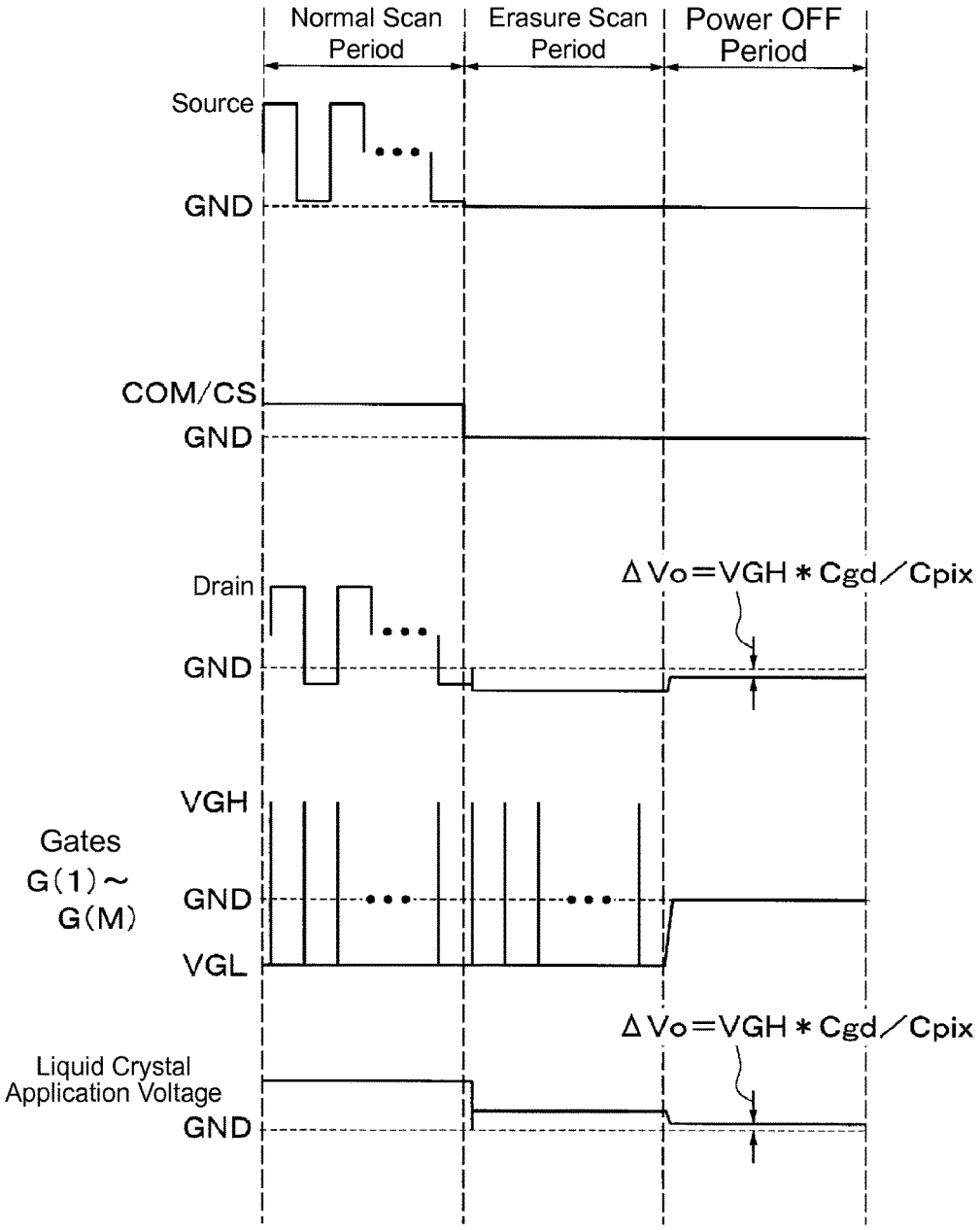
FIG. 7 is a timing chart for comparison in order to explain the effects of the present invention.

For reference, FIG. 7 shows an operation example in which the voltage of the source signal line S is set to GND in the erasure scan period (a configuration such as that in Patent Document 1, for example).

FIG. 7 is a timing chart referring to a comparison example in order to explain the effects of the present invention. The example shown in FIG. 7 is a waveform similar to that explained with reference to FIG. 4. In the example shown in FIG. 7, however, the potential of the opposite electrode COM is set to GND in the erasure scan period, and GND potential is written to the source voltage (i.e., drain voltage) to set the liquid crystal application voltage to 0V. Strictly speaking, however, the time at which the liquid crystal application voltage is 0V is when the gate potential is ON voltage VGH. Thereafter, when the gate potential becomes OFF voltage VGL, fluctuations occur in the drain potential due to coupling capacitance Cgd between gate/drain, and these fluctuations also occur when the gate potential changes from VGL to GND during power OFF. Therefore, at the point when the power turns completely OFF, a slight residual charge is generated. In such a case, a potential of ΔV0=VGH*Cgd/Cpix remains in the power OFF state.

(Pixels of Display Panel 102)

Next, the pixels of the display panel 102 included in the display device 100 according to the respective embodiments above will be explained.

In the display device 100 of the respective embodiments above, TFTs having so-called "oxide semiconductors" can be used as the switching devices TFTs 1 of the respective plurality of pixels P included in the display panel 102. In particular, it is preferable that TFTs 1 having an oxide constituted by indium (In), gallium (Ga), zinc (Zn), and oxygen (O) (also called In—Ga—Zn—O, indium-gallium-zinc-oxide, etc.) be used as the oxide semiconductor. The superior characteristics of TFTs using oxide semiconductors will be described below.

(TFT Characteristics)

Figure 8:
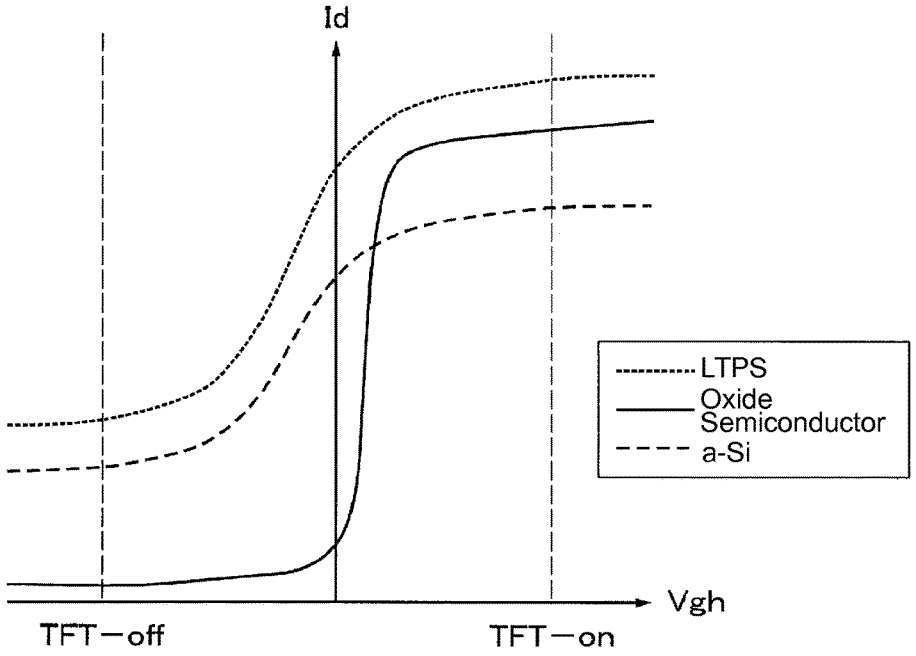
FIG. 8 is a view of characteristics of various types of TFTs, including a TFT using an oxide semiconductor.

FIG. 8 is a view of characteristics of various types of TFTs, including a TFT having an oxide semiconductor. FIG. 8 shows the respective characteristics of a TFT using an oxide semiconductor, a TFT using a-Si (amorphous silicon), and a TFT using LTPS (low-temperature polysilicon).

In FIG. 8, the horizontal axis (Vgh) shows the voltage value of an ON voltage supplied to the gate of the respective TFTs, and the vertical axis (Id) shows the amount of source-drain current in the respective TFTs. In particular, in FIG. 8, "TFT-on" represents a prescribed ON voltage, and "TFT-off" represents a prescribed OFF voltage.

As shown in FIG. 8, the TFT using an oxide semiconductor has higher electron mobility when ON than the TFT using a-Si. Specifically, although not shown, the TFT using a-Si has an Id current of 1 uA during TFT-on, whereas the TFT using an oxide semiconductor has an Id current of approximately 20 to 50 uA during TFT-on. Therefore, the TFT using an oxide semiconductor has an electron mobility when ON that is approximately 20 to 50 times higher than the TFT using a-Si and thus has superior ON characteristics.

Furthermore, as shown in FIG. 8, the TFT using an oxide semiconductor has less leakage current when ON than the TFT using a-Si. Specifically, although not shown, the TFT using a-Si has an Id current of 10 pA during TFT-off, whereas the TFT using an oxide semiconductor has an Id current of approximately 0.1 pA during TFT-off. Therefore, the TFT using an oxide semiconductor has approximately 1/100 of the leakage current when ON compared to the TFT using a-Si and thus has superior OFF characteristics where almost zero leakage current is generated.

It is preferable that the display device 100 of the present embodiment use such a TFT having an oxide semiconductor for each pixel. This enables the display device 100 of the present embodiment to have superior OFF characteristics for TFTs in the respective pixels, thereby making it possible to maintain for a long period of time the state in which the respective source signals of the plurality of pixels in the display panel are being written. Therefore, the display device 100 of the present embodiment can exhibit effects such as facilitating a decrease in the refresh rate of the display panel 102, for example.

On the other hand, in the display device 100 of the present embodiment, if a difference in potential occurs between the drain electrode and opposite electrode during power OFF in order to enhance the OFF characteristics of the respective pixels, it would be difficult to eliminate this difference in potential. The display device 100 of the present embodiment, however, adopts a configuration that does not allow such a difference in potential to occur; thus, defects such as pixel burn-in, liquid crystal degradation, and the like will also not occur.

Furthermore, the display device 100 of the present embodiment, in order to enhance the ON characteristics of the TFTs 1 in the respective pixels P, can drive the pixels using smaller TFTs, thereby allowing for the proportion of area that the TFTs occupy in each pixel to be made smaller.

In other words, the aperture ratio of each pixel can be increased, and the transmittance of light from the backlight can be enhanced. As a result, it is possible to use a backlight having low power consumption and to suppress luminance of the backlight, which can lower power consumption.

In addition, the display device 100 of the present embodiment, in order to enhance the ON characteristics of the TFTs in the respective pixels, can shorten the writing time of the source signals to the respective pixels, which can facilitate an increase in the refresh rate of the display panel 102.

Embodiment 2

Next, Embodiment 2 of the present invention will be described below with reference to the drawings.

Figure 5:
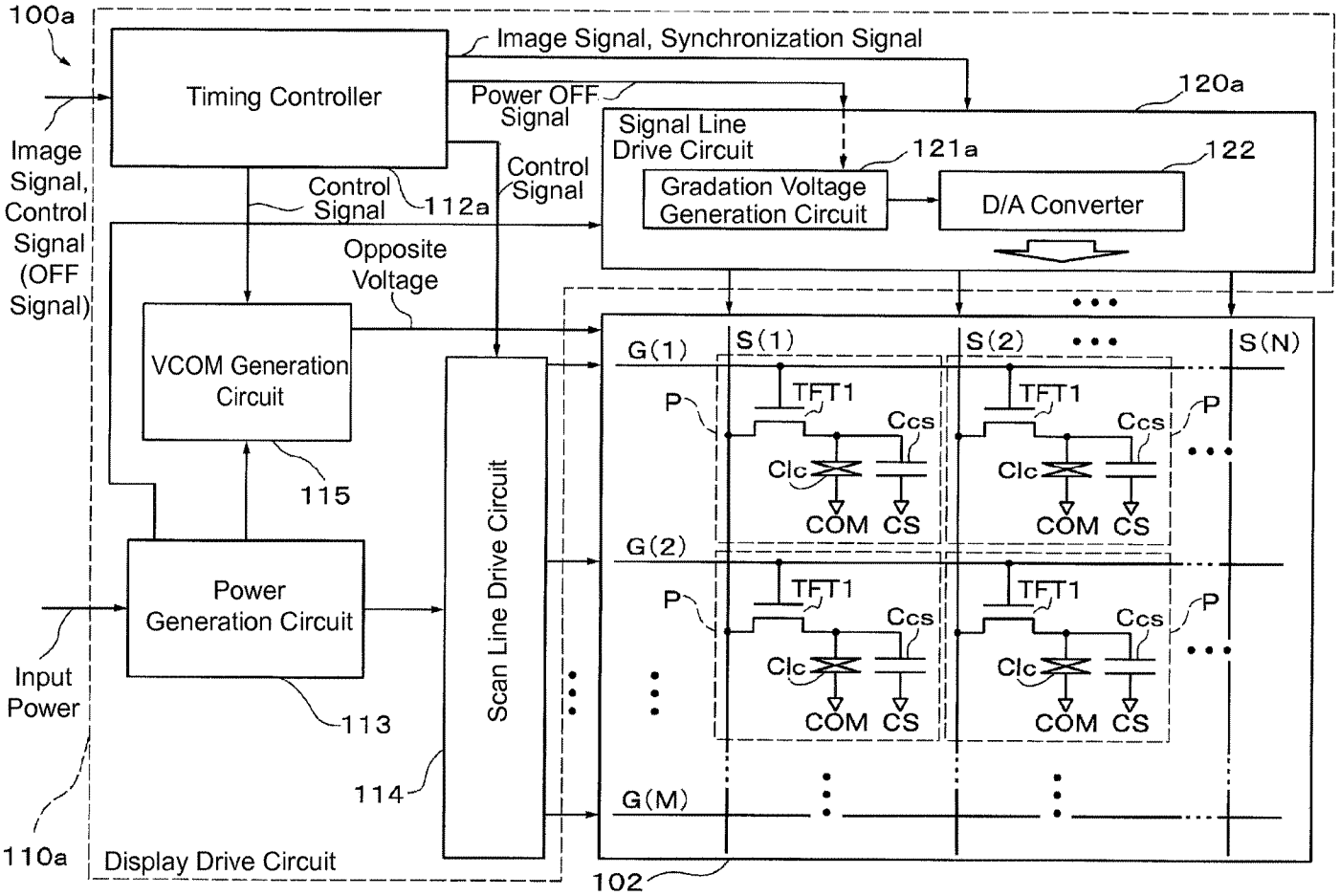
FIG. 5 is a block view of a configuration of primary components of a display device according to Embodiment 2 of the present invention.

FIG. 5 is a block diagram showing a configuration of primary parts of a display device according to Embodiment 2 of the present invention.

In FIG. 5, members having the same configuration as shown in FIG. 1 are given the same reference characters. Furthermore, for parts of the configuration that are different from FIG. 1, an "a" has been attached to the corresponding reference character used in FIG. 1. A microcontroller 112*a* shown in FIG. 5 differs from the microcontroller 112 shown in FIG. 1 in that the microcontroller 112*a* outputs a power OFF signal (power OFF control signal), for example. A signal line drive circuit 120*a* shown in FIG. 5 differs from the gradation voltage generation circuit 121 shown in FIG. 1 in that a gradation voltage generation circuit 121*a* generates a voltage outside the range of normal gradation voltage applied to the source signal lines S during the erasure scan period based on the power OFF signal.

The basic operations of a display device 100*a* and a display drive circuit 110*a* of Embodiment 2 are the same as that of the display device 100 and the display drive circuit 110 of Embodiment 1. In other words, in Embodiment 2, the basic operations explained with reference to FIG. 2 and FIG. 4 are the same as Embodiment 1. Embodiment 2, however, differs from Embodiment 1 as follows.

Namely, in Embodiment 1, it was presupposed that the potential VS written to the respective pixels P before power OFF were within a range of gradation voltage of a normal display state. It is possible, however, for the signal potential written before power OFF to exceed the range of gradation voltage during normal source signal line driving.

In such a case, the signal line drive circuit 120 cannot transmit pseudo-gradation data corresponding to a prescribed liquid crystal application voltage VS during the erasure scan period from the timing controller 112. Therefore, in Embodiment 2, the signal line drive circuit 120*a* is enabled additionally to receive a power OFF signal from the timing controller 112*a*. When the signal line drive circuit 120*a* receives the power OFF signal, the drive circuit controls the source signal lines S in the erasure scan period with the power OFF signal, thereby causing a voltage to be generated that is different from the gradation voltage during driving in a normal display state.

Figure 6:
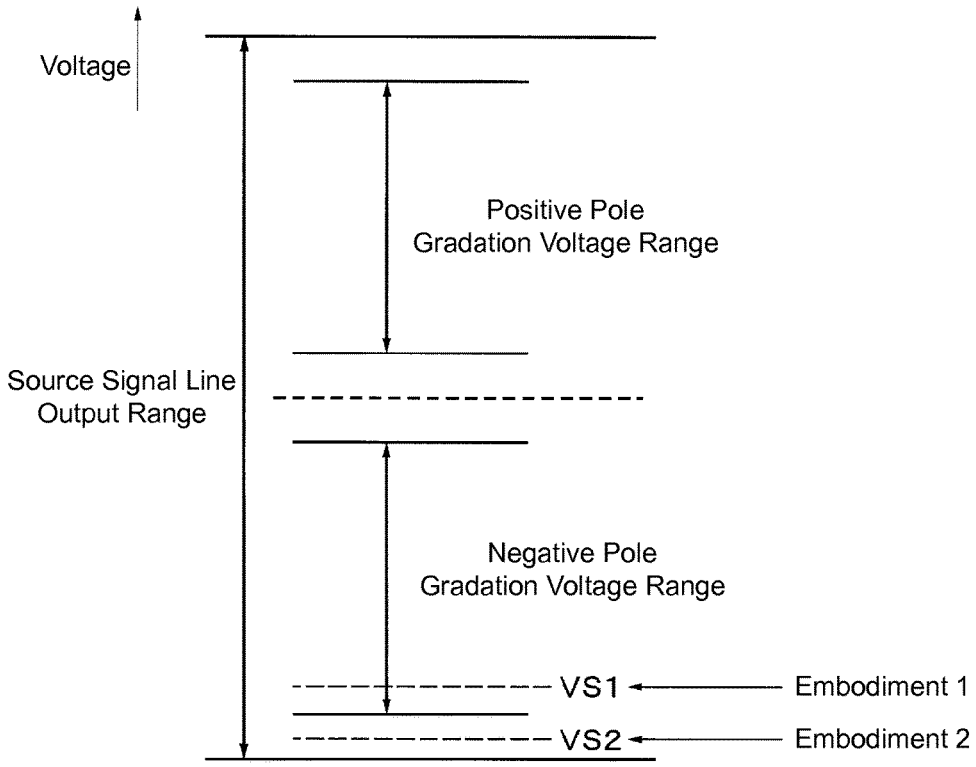
FIG. 6 is a view for explaining the relationship between a liquid crystal application voltage VS1 of Embodiment 1 and a liquid crystal application voltage VS2 of Embodiment 2 according to the present invention.

FIG. 6 is a view for explaining the relationship between the liquid crystal application voltage VS 1 of Embodiment 1 and a liquid crystal application voltage VS2 of Embodiment 2 according to the present invention. FIG. 6 shows one example of a liquid crystal drive voltage (VS1) during the erasure scan period of Embodiment 1 and the liquid crystal drive voltage (VS2) during the erasure scan period of Embodiment 2. As shown in FIG. 6, the liquid crystal drive voltage VS1 during the erasure scan period of Embodiment 1 is within either the positive gradation voltage range or negative gradation voltage range. The range of the voltage that can be output by the source signal lines S, however, is often set to exceed the range of the positive gradation voltage or the negative gradation voltage. Even in such a case, in Embodiment 1, the liquid crystal drive voltage VS1 must be stopped within the range of the positive gradation voltage or the negative gradation voltage.

In contrast, Embodiment 2 can remove this restraint. In other words, in Embodiment 2, a function is added whereby a liquid crystal drive voltage VS2 that exceeds the range of the positive gradation voltage or the negative gradation voltage and that is within the range of the output voltage of the source signal lines S is output to the signal line drive circuit 120*a* in accordance with the power OFF signal. This makes it possible, in Embodiment 2, to set the liquid crystal drive voltage VS2 in the erasure scan period to a voltage that exceeds normal gradation voltage.

The flow of the basic operations in the erasure scan period of Embodiment 2 is as follows. (1) When the timing controller 112*a* receives an OFF signal, the erasure scan period begins. (2) The operations of the respective units during the erasure scan period are as follows. The timing controller 112*a* transmits an OFF signal to the scan line drive circuit 114. The timing controller 112*a* then controls so as to become GND output with respect to the VCOM generation circuit 115 so as to become GND output (power supply OFF, GND voltage output, or the like). The signal line drive circuit 120*a* receives the OFF signal and writes VS voltage (VS2 in FIG. 6) from all lines S. The scan line drive circuit 114 scans the gate signal lines G as usual (depending on the driver, collective simultaneous writing is also possible). Next, (3) the operations of the respective units during the power OFF period are as follows. The timing controller 112*a* turns the power OFF. The output voltage of the signal line drive circuit 120*a* changes from VS to GND via power OFF. The output of the scan line drive circuit 114 changes from VGL to GND via power OFF. As a result of the above-mentioned operations, it is possible to make the ultimate voltage applied to the liquid crystal pixels 0V.

As described above, Embodiments 1 and 2 adopt a configuration for writing prescribed data signals to the respective pixels in the erasure scan period before the power OFF period. In such a case, to make the ultimate liquid crystal application voltage be 0V, an operation is performed whereby a prescribed liquid crystal application voltage is written to the respective pixels via the source signal lines S during the erasure scan period. At such time, the signal line drive circuit requires little or no change. Furthermore, the opposite electrode voltage need only be set to ground potential in the erasure scan period; thus, no problems occur related to modifications of the configuration of the opposite electrode voltage generation circuit, the control signal thereof, and the like. This point is explained further in the next paragraph.

Namely, one characteristic of the respective embodiments above is that, in order to make the ultimate liquid crystal application voltage 0V, the liquid crystal application voltage is left at a prescribed value in the erasure scan period. At such time, in the respective embodiments above, the potential of the opposite electrode is set to GND and the output voltage of the source driver is adjusted to leave this application voltage, for example. Therefore, no problems occur related to modifications of the configuration of the opposite electrode voltage generation circuit, the control signal thereof, and the like. The following is another possible method for leaving the liquid crystal application voltage during the erasure scan period. Namely, a configuration whereby the source driver output is set to GND and the voltage of the opposite electrode is switched to a prescribed voltage. In such a case, it is necessary to have a circuit for generating an opposite voltage that is not commonly used. However, if this configuration has a VCOM voltage generation circuit embedded inside the source driver, as has become mainstream in recent years, then there will be no significant issues related to adding configurations or the like. On the other hand, if using a model in which a VCOM voltage generation circuit is not embedded in the source driver and a circuit for VCOM is provided separately, then it is possible that this could increase the methods for switching between the two potentials and thus pose a problem.

Modification Example

It should be noted that the voltage written to the respective plurality of pixels P may differ for each pixel (or for each prescribed display area). In the plurality of pixels, characteristic variation may cause variations in the drain voltage, even if the application of the liquid crystal drive voltage VS is uniform, for example. In such a case, the display device 100 may differ the voltage applied for each pixel to prevent such variation of drain potential from occurring. For pixels having a drain potential that has become lower than the desired reference potential, the display device 100 may increase the voltage applied to these pixels in accordance with the differential, and for pixels having a drain potential that has become higher than the desired reference potential, the display device 100 may increase the voltage applied to these pixels in accordance with the differential, for example. In such a case, it is preferable that the display device 100 pre-store the voltage values or correction values for the respective pixels in a memory or the like. It is also preferable that the display device 100, in the ground scan period, stop polarity inversion of each frame.

(Supplemental Explanation)

Embodiments of the present invention were described above, but the present invention is not limited to the above-mentioned embodiments, and various modifications can be made without departing from the scope of the claims.

Namely, embodiments, drive methods of drive devices, and display methods of display devices obtained by combining techniques modified without departing from the scope of the claims are also included in the technical scope of the present invention, for example.

INDUSTRIAL APPLICABILITY

One aspect of the present invention can be applied to a drive device or the like where it is necessary to reduce the difference in potential between the drain electrodes of the respective pixels and the opposite electrode during power OFF.

DESCRIPTION OF REFERENCE CHARACTERS

100, 100*a* display device
102 display panel
110, 110*a* display drive circuit (drive device)
112, 112*a* timing controller
113 power generation circuit
114 scan line drive circuit
115 VCOM generation circuit (opposite electrode voltage generation circuit)
120, 120*a* signal line drive circuit
121, 121*a* gradation voltage generation circuit
126 D/A converter
P pixel
TFT 1 TFT
Clc liquid crystal capacitance
Ccs auxiliary capacitance
G(1), G(2), . . . , G(M) gate signal line
S(1), S(2), . . . , S(N) source signal line
COM opposite electrode

What is claimed is:

1. A drive device for driving a display panel equipped with pixels each having a transistor including a drain electrode, a source electrode, and a gate electrode, gate signal lines connected to gate electrodes of the respective transistors, and source signal lines connected to source electrodes of the respective transistors, said drive device comprising:

a scan line drive circuit that sequentially selects the gate signal lines for scanning;

a signal line drive circuit that writes data signals to the respective plurality of pixels connected to each of the gate signal lines that has been selected; and an opposite electrode voltage generation circuit that generates a potential for an opposite electrode that is opposite to the respective pixels, wherein, when the drive device enters a turn OFF sequence for turning OFF the display panel, the signal line drive circuit writes prescribed data signals to the respective pixels via the source signal lines before turning OFF the display panel such that, after the display panel is turned OFF, a potential of the drain electrodes of the respective pixels becomes equal to the potential of the opposite electrode, and wherein the prescribed data signals are signals applied to the source electrodes by the signal line drive circuit, said prescribed data signals having a liquid crystal application voltage of VS=VGH*Cgd/(Clc+Ccs+Cgd), where VS is the liquid crystal application voltage, VGH is gate-ON voltage, Cgd is coupling capacitance between gate-drain, Clc is liquid crystal capacitance, and Ccs is auxiliary capacitance.

2. The drive device according to claim 1, further comprising:

a timing controller that outputs image signals indicating gradation values of the respective pixels to the signal line drive circuit and a control signal for indicating an output timing of the image signals, wherein, when the drive device enters the turn OFF sequence for turning OFF the display panel, the timing controller outputs a prescribed image signal indicating gradation values such that, after the display panel is turned OFF, the potential of the drain electrodes of the respective pixels becomes equal to the potential of the opposite electrode, and wherein the prescribed data signals written by the signal line drive circuit are generated by the signal line drive circuit in accordance with the image signals received from the timing controller.

3. The drive device according to claim 1, further comprising:

a timing controller that outputs a power OFF control signal for instructing a power OFF operation to the signal line drive circuit when the drive device enters the turn OFF sequence for turning OFF the display panel, wherein the signal line drive circuit, in response to the power OFF control signal from the timing controller, writes the prescribed data signals to the respective pixels via the source signal lines before turning OFF the display panel such that, after the display panel is turned OFF, the potential of the drain electrodes of the respective pixels becomes equal to the potential of the opposite electrode.

4. The drive device according to claim 3, wherein the signal line drive circuit, when writing the prescribed data signals to the respective pixels, collectively selects a prescribed plurality of the gate signal lines.

5. A drive method for driving a display panel equipped with pixels each having a transistor including a drain electrode, a source electrode, and a gate electrode, gate signal lines connected to gate electrodes of the respective transistors, and source signal lines connected to source electrodes of the respective transistors, said drive method comprising:

using a scan line drive circuit that sequentially selects the gate signal lines for scanning, a signal line drive circuit that writes data signals to the respective plurality of pixels connected to each of the gate signal lines that has been selected, and an opposite electrode voltage generation circuit that generates a potential of an opposite electrode that is opposite to the respective pixels;

receiving, by the signal line drive circuit, a power OFF control signal for instructing a power OFF operation; and writing, by the signal line drive circuit in response to the power OFF control signal, prescribed data signals to the respective pixels via the source signal lines before turning OFF the display panel such that, after the display panel is turned OFF, a potential of the drain electrodes of the respective pixels becomes equal to the potential of the opposite electrode, wherein the prescribed data signals are signals applied to the source electrodes by the signal line drive circuit, said prescribed data signals having a liquid crystal application voltage of $VS=VGH*Cgd/(Clc+Ccs+Cgd)$, where VS is the liquid crystal application voltage, VGH is gate-ON voltage, Cgd is coupling capacitance between gate-drain, Clc is liquid crystal capacitance, and Ccs is auxiliary capacitance.

6. A drive device for driving a display panel equipped with pixels each having a transistor including a drain electrode, a source electrode, and a gate electrode, gate signal lines connected to gate electrodes of the respective transistors, and source signal lines connected to source electrodes of the respective transistors, said drive device comprising:

a scan line drive circuit that sequentially selects the gate signal lines for scanning;

a signal line drive circuit that writes data signals to the respective plurality of pixels connected to each of the gate signal lines that has been selected;

an opposite electrode voltage generation circuit that generates a potential for an opposite electrode that is opposite to the respective pixels; and a timing controller that outputs image signals indicating gradation values of the respective pixels to the signal line drive circuit and a control signal for indicating an output timing of the image signals, wherein, when the drive device enters a turn OFF sequence for turning OFF the display panel, the signal line drive circuit writes prescribed data signals to the respective pixels via the source signal lines before turning OFF the display panel such that, after the display panel is turned OFF, a potential of the drain electrodes of the respective pixels becomes equal to the potential of the opposite electrode, wherein, when the drive device enters the turn OFF sequence for turning OFF the display panel, the timing controller outputs a prescribed image signal indicating gradation values such that, after the display panel is turned OFF, the potential of the drain electrodes of the respective pixels becomes equal to the potential of the opposite electrode, and wherein the prescribed data signals written by the signal line drive circuit are generated by the signal line drive circuit in accordance with the image signals received from the timing controller.

7. A display device, comprising:

the drive device as set forth in claim 1; and a display panel driven by said drive device, equipped with pixels each having a transistor including a drain electrode, a source electrode, and a gate electrode, gate signal lines connected to gate electrodes of the respective transistors, and source signal lines connected to source electrodes of the respective transistors.

* * * * *